US007197371B2

(12) United States Patent
Koichi et al.

(10) Patent No.: US 7,197,371 B2
(45) Date of Patent: Mar. 27, 2007

(54) METHOD AND DEVICE FOR KNIT DESIGN

(75) Inventors: Terai Koichi, Wakayama (JP); Nishida Kenji, Wakayama (JP)

(73) Assignee: Shima Seiki Manufacturing, Ltd., Wakayama (JP)

( * ) Notice: Subject to any disclaimer, the term of this patent is extended or adjusted under 35 U.S.C. 154(b) by 0 days.

(21) Appl. No.: 10/551,194

(22) PCT Filed: Mar. 15, 2004

(86) PCT No.: PCT/JP2004/003440

§ 371 (c)(1),
(2), (4) Date: Sep. 29, 2005

(87) PCT Pub. No.: WO2004/088022

PCT Pub. Date: Oct. 14, 2004

(65) Prior Publication Data

US 2006/0179894 A1 Aug. 17, 2006

(30) Foreign Application Priority Data

Mar. 31, 2003 (JP) ..... 2003-094039

(51) Int. Cl.
*D04B 7/24* (2006.01)

(52) U.S. Cl. ..... 700/141

(58) Field of Classification Search ..... 700/131, 700/132, 135, 130, 141
See application file for complete search history.

(56) References Cited

U.S. PATENT DOCUMENTS

| | | | | |
|---|---|---|---|---|
| 6,698,253 | B2 * | 3/2004 | Stoll et al. | 66/232 |
| 6,845,285 | B2 * | 1/2005 | Kakimoto et al. | 700/141 |
| 6,865,439 | B1 * | 3/2005 | Tu | 700/131 |
| 6,880,367 | B2 * | 4/2005 | Suzuki | 66/232 |
| 6,882,897 | B1 * | 4/2005 | Fernandez | 700/132 |
| 6,928,335 | B1 * | 8/2005 | Zweigle | 700/131 |

FOREIGN PATENT DOCUMENTS

| | | |
|---|---|---|
| JP | 5-78960 A | 3/1993 |
| JP | 2631946 B2 | 7/1997 |
| JP | 11-25281 A | 1/1999 |
| JP | 2913266 B2 | 6/1999 |
| WO | WO 01/64987 A1 | 9/2001 |

* cited by examiner

*Primary Examiner*—Danny Worrell
(74) *Attorney, Agent, or Firm*—Rothwell, Figg, Ernst & Manbeck

(57) ABSTRACT

When a target area 4 is designated at an end of a knitted fabric or the like, by sliding the target area 4, the target area 4 is deformed into a target area 5. The design of the knitted fabric is inputted to the target area 5. After the design, the target area 5 is returned to the original position to create a target area 6.

3 Claims, 6 Drawing Sheets

30

METHOD AND DEVICE FOR KNIT DESIGN

CROSS REFERENCE TO RELATED APPLICATION

This application is a 35 USC § 371 National Phase Entry Application from PCT/JP2004/003440, filed Mar. 15, 2004, and designating the United States.

TECHNICAL FIELD

The present invention relates to a design of a knitted fabric used in a knitting machine.

BACKGROUND ART

Japanese Patent Publication No. 2,631,946 (U.S. Pat. No. 5,557,527) discloses a design of a knitted fabric for knitting by a flat knitting machine. The design of the knitted fabric is performed on a computer. The outer shape of the knitted fabric is inputted as an image, and the types of knitting stitches or the like are inputted using color codes or the like. Usual, but complicated processes such as decreased stitches, increased stitches, or bind off stitches are carried out by storing a subroutine, and retrieving the subroutine from a library. The design data as created can be converted automatically into knitting data used in the flat knitting machine.

In portions of the knitted fabric such as an armhole, a neck hole, and a placket, a tissue which is different from the other portion may be used for the width of about several wales from the end of the knitted fabric. These portions may have complicated shapes that are not simple like a rectangle, due to the increased stitches or the decreased stitches. Therefore, it is necessary to input the design for the width of several stitches from the end of the knitted fabric for each course, and the operation is very laborious.

SUMMARY OF THE INVENTION

An object of the present invention is to simplify the design at the end of the knitted fabric or the like.

Structure of the Invention

In a knit design method of the present invention, an image representing a design of a knitted fabric is inputted in accordance with an input of a user for generating knitting data used in a knitting machine. The method comprises the steps of sliding an area designated by the user in a course direction to deform the area into an area having a simple shape, changing design data of the deformed area in accordance with the input of the user, and then, returning the area after the change of design data to the original position before sliding.

Preferably, the area comprises an oblique stripe-like portion at an end of the knitted fabric, and is deformed by sliding into a shape in which the longitudinal direction of the area is vertically substantially straight.

In a knit design apparatus of the present invention, an image representing a design of a knitted fabric is inputted in accordance with an input of a user for generating knitting data used in a knitting machine. The apparatus comprises means for sliding an area designated by the user in a course direction to deform the area into an area having a simple shape, means for changing design data of the deformed area in accordance with the input of the user, and means for returning the area after the change of the design data to the original position before sliding.

Operation and Advantages of the Invention

In the knit design method and apparatus of the present invention, when the user selects the desired area, by sliding the area in a course direction, the area is converted into a simple shape such as a rectangle. That is, the oblique stripe-like area at the jaggy edge of the knitted fabric is converted to have a simple shape for design. The area after the design, i.e., the area after the change of the design data is returned to the original position in the image. Therefore, the design for the edge of the knitted fabric or the like is simplified.

The areas suitable for the process in the invention are the strip-like portion at the edge of the armhole or the neck hole, the placket, and the joint portion between the sleeve and the body. The process of the present invention may be applied to other portions. The strip-like area at the edge of the armhole or the neck hole has a jaggy shape due to decreased stitches or the like, and positioned obliquely. Therefore, the design is often performed for the long and narrow area of several wales from the edge. It is difficult to directly change the design of the oblique stripe-like area. Thus, in the present invention, instead of designing the area, e.g., at the end of the knitted fabric having, e.g., an irregular shape by shifting the designing position obliquely for each course by, e.g., several wales, it is possible to design the vertically regular simple shape such as a rectangle.

EMBODIMENT

Figure 1:
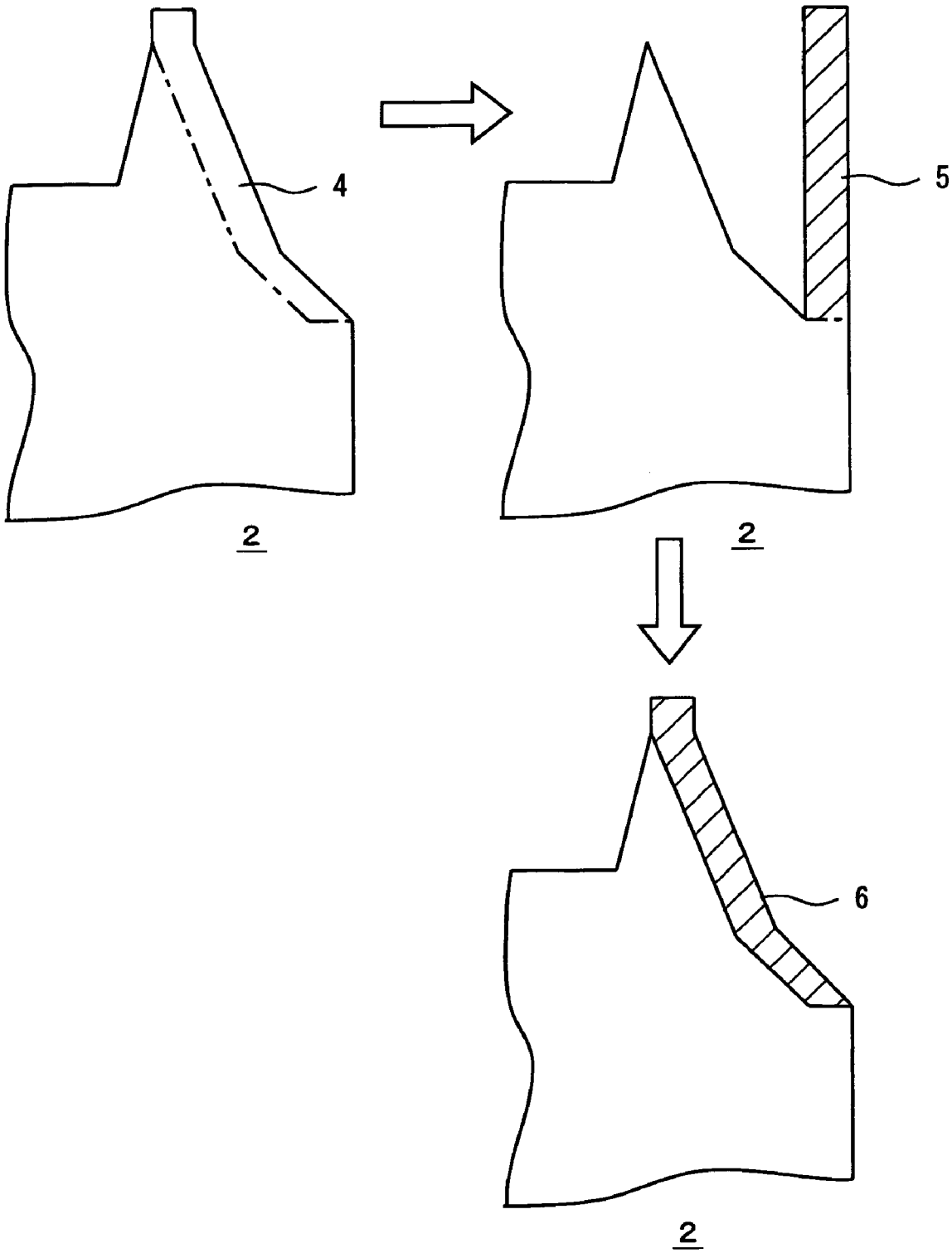
FIG. 1 is a view schematically showing a design around an armhole using a method according to an embodiment.

An embodiment will be described with reference to FIGS. 1 to 7. In FIG. 1, a reference numeral 2 denotes a front body in a design process. For example, a design such as a stitch pattern, or a structured pattern by the stitch species is inputted to a target area 4 along an armhole of the front body 2. The target area 4 has a jaggy margin due to decreased stitches at the armhole, and has the width of several wales to 20 wales at the maximum. The target area 4 is an elongated, oblique stripe-like area. In the conventional technique, in this case, design data such as a color code is inputted to the target area 4 for each course one by one. The target area 4 has an irregular shape. Therefore, each time the design data is inputted for one course, it is necessary to shift the input position laterally.

In the embodiment, in this case, when the target area 4 is designated, by sliding the respective courses in the target area 4 laterally along the course direction, the target area 4 is deformed to have a simple shape such as a rectangle. A reference numeral 5 denotes a deformed target area. Then, suitable design data is inputted to the deformed target area 5, and the design such as a stitch pattern is created. Then, after the design data is inputted to the target area 5, by sliding the target area 5 in the opposite direction back to the original position, a target area 6 after the input of the design data is created.

Figure 2:
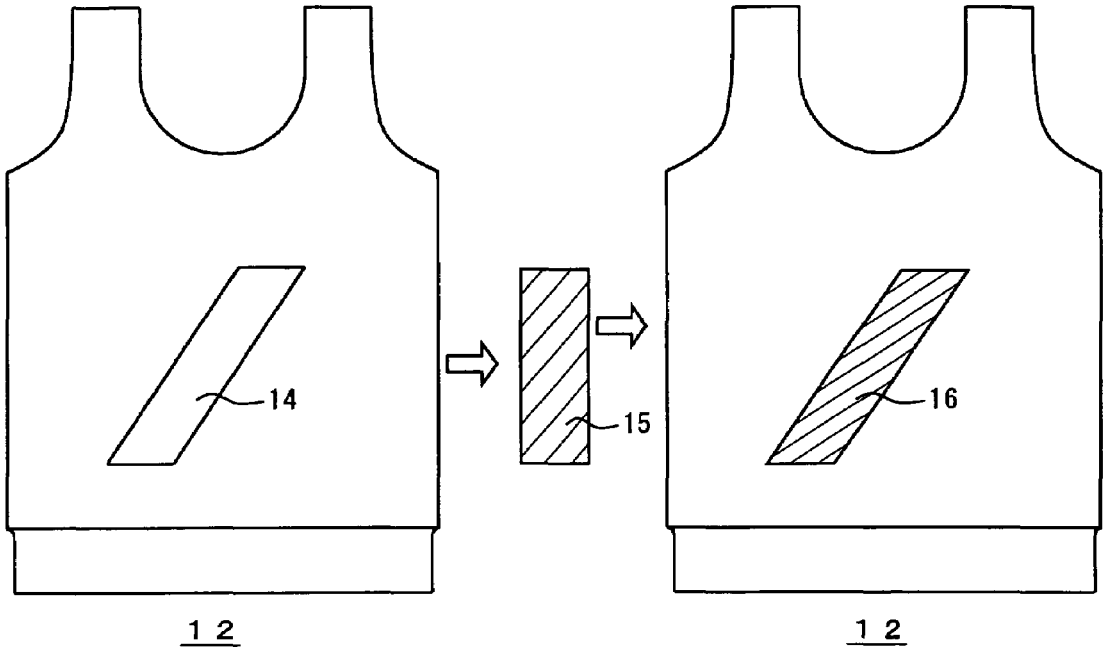
FIG. 2 is a view schematically showing a design of a pattern at a central portion of a body using the method according to the embodiment.

In particular, the present invention is suitably applicable to strip-like portions such as a portion around the armhole or the neck hole. However, the present invention is not limited in this respect. In FIG. 2, a target area 14 having a parallelogram shape is designated at a central portion of a front body 12. The target area 14 is deformed into a rectangular target area 15. Then, after design data is inputted to the target area 15, by returning the target area 15 to the original position, a target area 16 is created.

Figure 3:
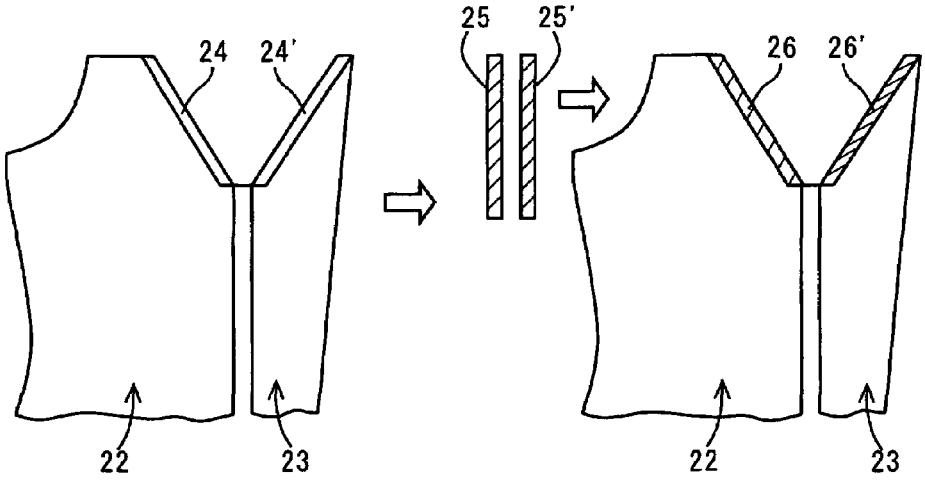
FIG. 3 is a view schematically showing a design at joint portions between a body and a sleeve using the method according to the embodiment.

FIG. 3 shows an example in which the present invention is applied to joint portions between a sleeve and a body. A reference numeral 22 denotes a front body, and a reference numeral 23 denotes a sleeve. The joint portions between the front body 22 and the sleeve 23 are designated as target areas 24, 24'. Then, by sliding the target areas 24, 24' in the course direction, target areas 25, 25' shown at the center in FIG. 3 are taken out. Design data is inputted to the target areas 25, 25'. Then, by sliding the target areas 25, 25' back to the original position, target areas 26, 26' after the input of the design data are obtained.

In any of the cases in FIGS. 1 to 3, the design data is inputted to a simple shape such as a rectangle instead of a curved stripe-like area or an area having a parallelogram shape. The design is performed easily. Further, in the case of FIG. 3, the design is performed with the image of the state in which the sleeve 23 is jointed to the body 22. The image of design data after deformation by sliding may be displayed at a position which is overlapped on the image of the original knitted fabric, or may be displayed at a position which is not overlapped on the image of the original knitted fabric.

Figure 4:
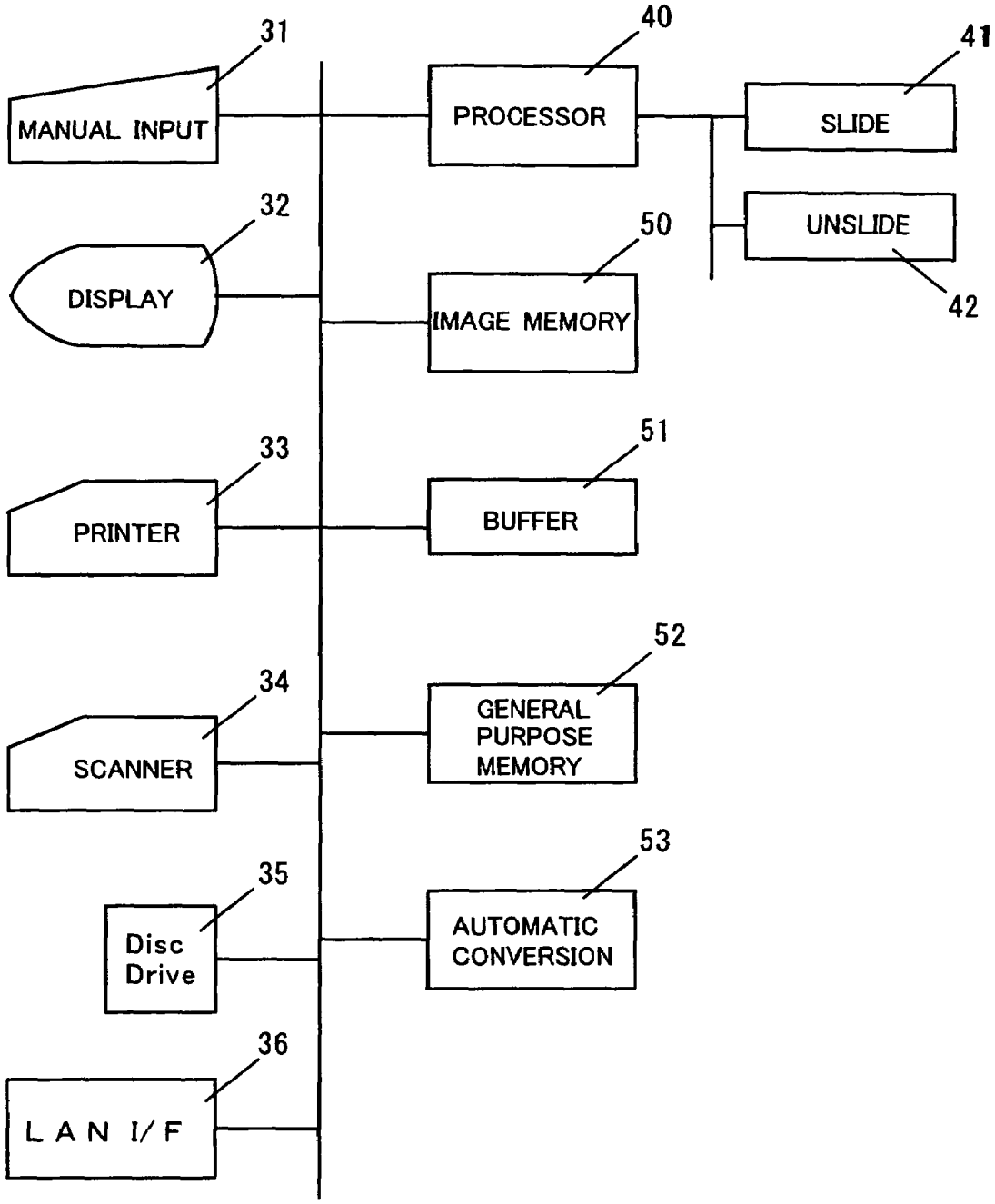
FIG. 4 is a block diagram of a knit design apparatus according to the embodiment.

FIG. 4 is a view showing structure of a knit design apparatus 30 according to the embodiment. A reference numeral 31 denotes a manual input device. Data such as the outer shape or the tissue of the knitted fabric, and patterns such as Intersia or Jacquard is inputted by a stylus, a mouse, or a track ball. A reference numeral 32 denotes a display. For example, a design image of the kitted fabric or the like is displayed on a liquid display. A reference numeral 33 denotes a printer for outputting the design image of the knitted fabric or the like. A scanner 34 reads data such as the outer shape or the color of the knitted fabric or data such as Jacquard. A disc drive 35 drives a magneto-optical disc, a floppy (trademark) disc, or a hard disc for the input/output of the design data of the knitted fabric. A LAN interface 36 is used for inputting/outputting design data of the knitted fabric, or inputting/outputting knitting data converted from the design data for a knitting machine such as a flat knitting machine.

A processor 40 carries out a general image processing. For example, the processor 40 processes the design of the knitted fabric inputted as image data by a user. A slide processing unit 41 slides an area (target area) designated in the knitted fabric for deforming the area into an area having a simple shape. An unslide processing unit 42 releases the slide such that the slid image is rewritten at the original position.

An image memory 50 stores the design data designed as an image. A buffer 51 stores various items of temporal data. A general purpose memory 52 stores data other than the image data. An automatic conversion processing unit 53 converts the data of the knitted fabric designed as the image into the knitting data used in the flat knitting machine or the like.

Figure 5:
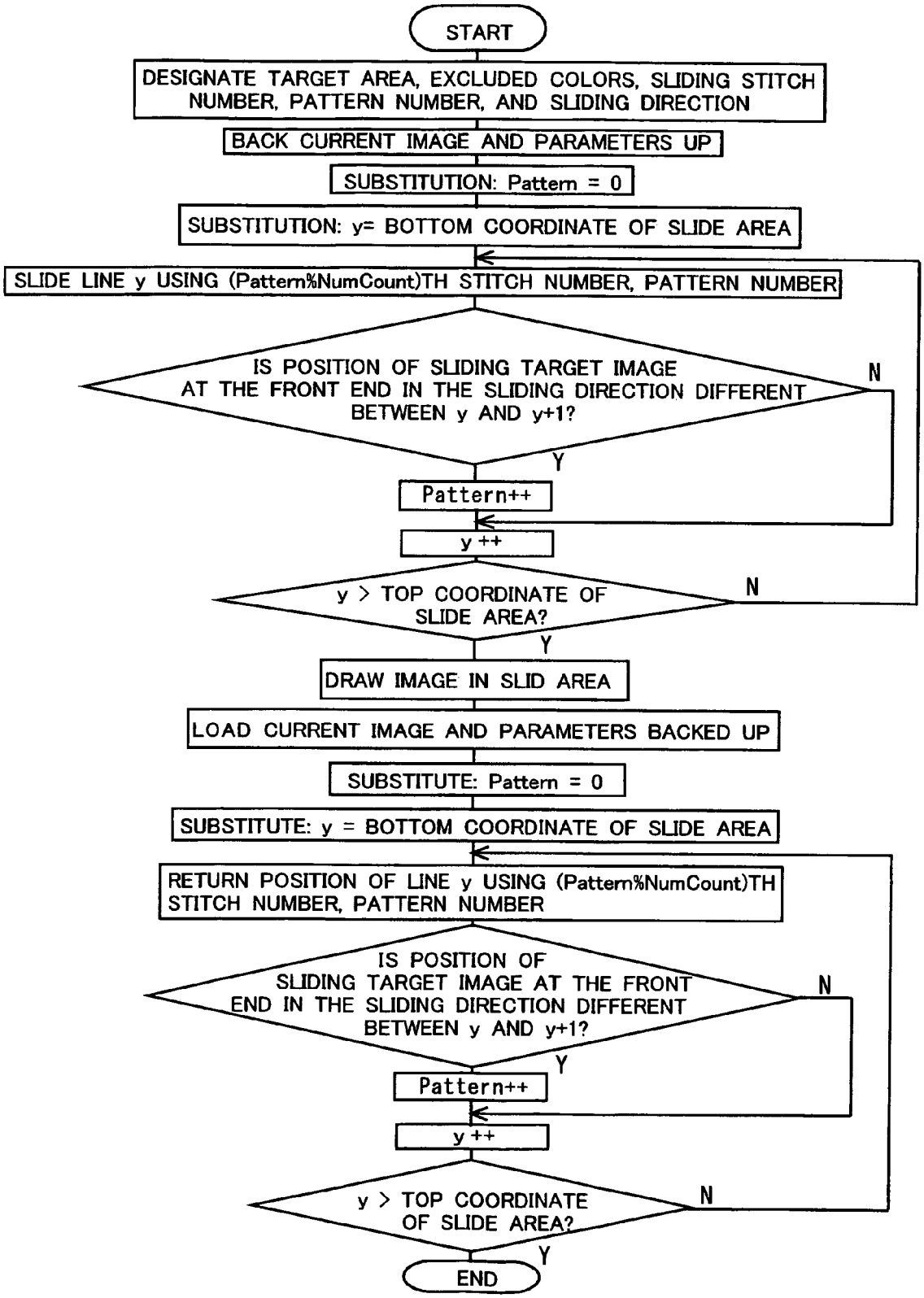
FIG. 5 is a flowchart showing an algorism of a design method according to the embodiment.
Figure 6:
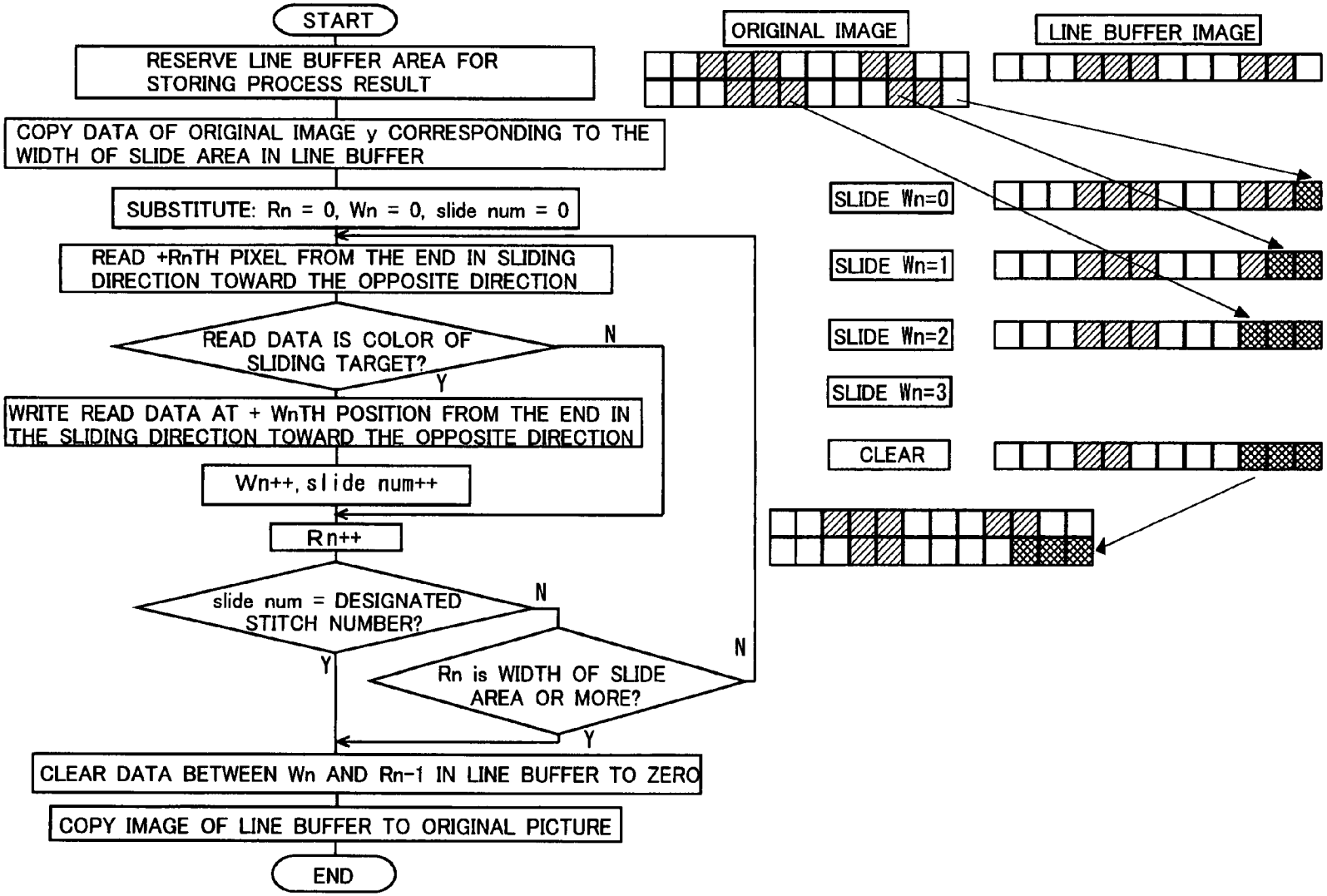
FIG. 6 is a flowchart showing an algorism of a slide process according to the embodiment.
Figure 7:
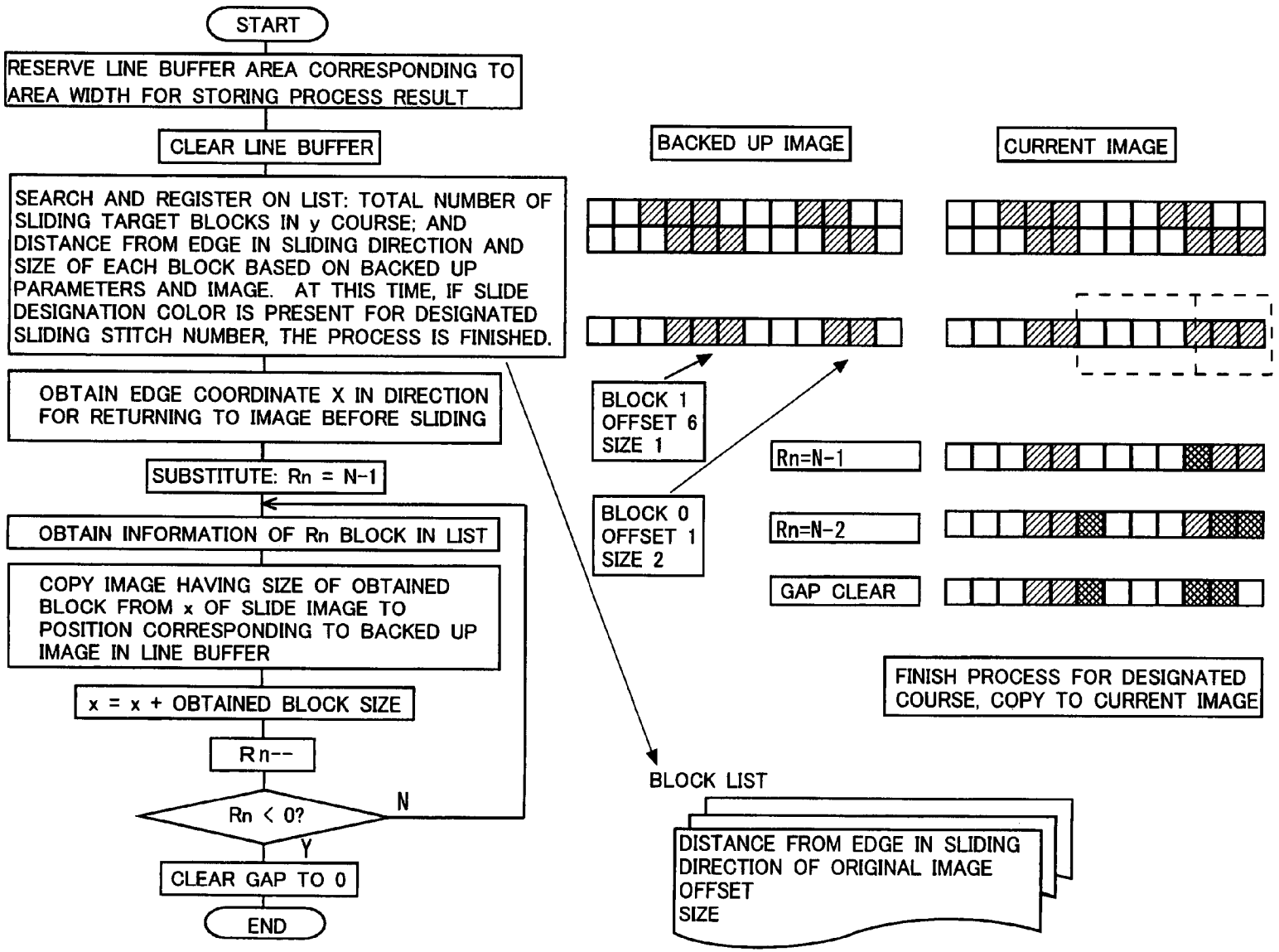
FIG. 7 is a flowchart for releasing the slide to return to the design data of the original position according to the embodiment.

FIGS. 5 to 7 show an algorism for designating a target area, sliding the target area, and after inputting the design data to the slid area, returning the slid area back to the original position. In FIG. 5, the overview of the algorism is shown. Initially, a target area is designated. It is likely that the target area is positioned at the end of the knitted fabric. Colors outside the area of the kitted fabric are designated as excluded colors. Even within the area of knitted fabric, colors of the portion which is not the target of the slide are also designated as excluded colors. Further, items such as the upper end and the lower end of the target area are inputted. The sliding stitch number (the stitch number for one course) can be designated in one to four patterns (the number of patters is a constant Num Count), and the sliding stitch number is designated for each of the patterns. Additionally, a sliding direction is designated. Instead of designating the target area using numeric values, it is possible to designate the target area by a predetermined color (designation color). The method of designating the target area itself is not limited as long as it can designate an area inside an image.

Then, the image before sliding, and parameters such as the excluded colors and the target area are backed up, and stored. The initial value of a variable Pattern is set to "0", and the y coordinate of the bottom of the slide area (target area) is substituted for the variable y. Then, for each of the lines, the remainder calculated by dividing the variable Pattern by the constant Num Count (the number of patterns of the sliding stitch number) is determined. Since the patterns of the sliding stitch number for the constant Num Count (number of patterns) have already been input, in the case where Num Count is 4, for example, the sliding stitch number for each of the values of 0 to 3 have already been input. Therefore, using the reminder, the sliding stitch number is calculated. The area corresponding to the determined stitch number is designated in the designated sliding direction to convert the target area into an area having a simple shape such as a rectangle.

When a predetermine event occurs, the variable Pattern is incremented, e.g., one by one. For example, if the image position of the sliding target at the front end in the sliding direction is different between the previous row (y) and the next row (y+1), the pattern number is incremented by 1. Then, when the variable Pattern is changed, the sliding stitch number is changed. Therefore, it is possible to change the width of the target area by the predetermined event. Thus, each time the slide of one course is performed, the value of the variable y is incremented by one. The process is repeated until the top coordinate of the slide area is reached. By sliding the target area as described above, it is possible to deform the target area into an area having a simple shape as shown in FIGS. 1 to 3. An image is drawn for the target area after sliding, and the desired design data is inputted.

At the time of releasing the slide, the backed up parameters and the image are loaded, the initial value of the variable Pattern is set to "0", and the initial value of the variable y is set to the bottom coordinate of the slide area. Since the sliding stitch number for the constant Num Count has already been stored, based on the reminder calculated by dividing the variable Pattern by the constant Num Count, the sliding stitch number is determined to return the target area to the original position. The change (increment) of the variable Pattern is performed in the same manner as described above. Each time the process of one line is performed, the variable y is incremented by one. The process is repeated until the top coordinate of the slide area is reached.

FIG. 6 shows the details of the slide process at the upper part in FIG. 5. The line buffer area for storing the data after sliding is reserved. The original image data before sliding corresponding to the width of the slide area is copied to the line buffer. Then, the initial values of the variable Rn, the variable Wn, and the variable slide num are set to "0". In the embodiment, the sliding direction is in the right direction, and the opposite direction is in the left direction. The Rnth pixel from the end in the sliding direction (right end) toward the left side is read, and it is checked whether the read data represents the color of the sliding target (whether the read data represents the excluded colors). If the read data represents the data of the sliding target, the data is written to the Wnth pixel from the end in the sliding direction toward the opposite direction in the line buffer. After performing these processes, the variable Wn is incremented by 1, and the variable slide num is incremented by 1. Since reading of one pixel is finished, the variable Rn is incremented by 1 regardless of whether the writing operation has been performed or not.

Then, it is checked whether the variable slide num has reached the designated stitch number. Even in the case where the sliding stitch number (variable slide num) is small, if a large number of pieces of data of the excluded colors are included, and the read data corresponds to the width of the slide area or more, it is determined that the process for one line is finished. When the process for one line is finished, data of the line buffer from the coordinate Wn to the coordinate Rn−1is cleared to 0 (the initial value of the coordinate is 0). Then, by copying the image of the line buffer to the original image, it is possible to carry out the sliding operation for the designated stitch number in the slide area.

On the right side in FIG. 6, the original image before sliding and the image of the line buffer are shown. In the original image, pixels of the white color (excluded color) are present between two blocks (hatched pixels). Therefore, even in the case of the data of the knitted fabric having an area of the excluded color in the middle, it is possible to carry out the sliding operation. In the case of FIGS. 1 to 3, the slide area is positioned at the end of the knitted fabric. Therefore, it is not likely that there is any area of the excluded color in the slide area. The pixels with halftone dot meshing in the line buffer are the slid pixels. The variable Wn is incremented by 3 by three sliding operations, and the final value of the variable Wn is 3.

FIG. 7 shows the process of returning the image created by inputting the design data after sliding, to the original position. An area of the line buffer corresponding to the width of the area for storing the process result is reserved, and the reserved area is cleared. Based on the backed up parameters and the image, the total number N of the blocks of the sliding target, the distance from the edge in the sliding direction and the size for each block are searched, and registered on a list. The process is carried out by extracting the blocks which are not the target of the slide release from the line buffer. For example, in the case shown on the right side in FIG. 7, the portion of the excluded color corresponds to the white pixels, and the pixels with halftone dot meshing are the pixels to be slid back to the original position. In operation, the current image is copied to the line buffer.

On the right side shown in FIG. 7, two blocks, the block 0 and the block 1 are the sliding target. The offset of the block 0 is 1, and the size of the block 0 is 2. The offset of the block 1 is 6, and the size of the block 1 is 1. In the line buffer, the pixels slid to the pixels 0, 1, 2 (size 1+size 2) are set. Since the pixel 3 does not have any data, the initial value of the edge coordinate x is 2. Next, the block number 1 is substituted, and based on the data of the block 1, the size of the block is confirmed as 1, and one pixel is rewritten at the original position. The coordinate where the data is rewritten is determined based on the offset and the size of the block 1. The value of the variable x is obtained, and changed by the degree corresponding to the size of the slid block. Then, the process proceeds to the next block. After the process is performed for all of the blocks, the unnecessary pixels (gap) are cleared to 0.

In the embodiment, a narrow stripe-like area such as the edge of the armhole or the edge of the neck hole is converted into an area having a simple shape such as a rectangle, and the simple shape is used for design. After the design, the area is returned to the original position. Therefore, it is possible to design the area in the end of the knitted fabric easily.

The invention claimed is:

1. A knit design method of creating an image representing a design of a knitted fabric in accordance with an input of a user for generating knitting data used in a knitting machine, the method comprising the steps of:

deforming an area having an irregular shape designated by the user in a course direction area into an area having a regular shape;

changing design data of the deformed area in accordance with the input of the user; and then, returning the area after the change of design data to the original position before deforming.

2. A knit design method according to claim 1, wherein the area having an irregular share comprises an oblique stripe-like portion at an end of the knitted fabric, and is deformed into a shape in which the longitudinal direction of the area is vertically substantially straight.

3. An apparatus for creating an image representing a design of a knitted fabric in accordance with an input of a user, and converting the image into knitting data used in a knitting machine, the apparatus comprising:

means for processing the image to convert an area having an irregular shape designated by the user in a course direction to deform the area into an area having a regular shape;

means for changing design data of the deformed area in accordance with the input of the user; and means for processing the image to returning the area after the change of the design data to the original position before sliding.

* * * * *